US006371789B1

(12) United States Patent
Sato et al.

(10) Patent No.: US 6,371,789 B1
(45) Date of Patent: Apr. 16, 2002

(54) CONNECTION APPARATUS HAVING AN IMPROVED LOCKING MECHANISM FOR MAINTAINING A CONNECTION STATE

(75) Inventors: Yukiko Sato, Akishima; Yosuke Saito, Oume; Ryusuke Murayama, Tokyo, all of (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 09/668,881

(22) Filed: Sep. 25, 2000

(30) Foreign Application Priority Data

May 10, 2000 (JP) ..... 2000-137598

(51) Int. Cl.[7] ..... H01R 13/648
(52) U.S. Cl. ..... 439/358
(58) Field of Search ..... 439/358, 327, 439/353, 357, 350, 939, 138, 567, 540.1, 570, 326, 562

(56) References Cited

U.S. PATENT DOCUMENTS 4,911,659 A * 3/1990 Visalli ..... 439/570
5,147,220 A * 9/1992 Lybrand ..... 439/567
5,383,794 A * 1/1995 Davis et al. ..... 439/352
5,401,189 A * 3/1995 Sato ..... 439/507
5,564,945 A * 10/1996 Domingos et al. ..... 439/607
5,603,639 A * 2/1997 Lai et al. ..... 439/607
5,713,752 A * 2/1998 Leong et al. ..... 439/358
5,807,135 A * 9/1998 Clark ..... 439/357
5,971,790 A * 10/1999 Rohde ..... 439/357
6,116,941 A * 9/2000 Kuo ..... 439/357
6,149,451 A * 11/2000 Weber ..... 439/358
6,168,453 B1 * 1/2001 Kuo ..... 439/357

FOREIGN PATENT DOCUMENTS

JP 4-16886 12/1992 ..... H01R/13/639
JP 5-68085 10/1993 ..... H01R/13/639

* cited by examiner

*Primary Examiner*—Tho D. Ta
*Assistant Examiner*—Phuongchi Nguyen
(74) *Attorney, Agent, or Firm*—Michael Best & Friedrich LLC; Laff, Whitesel & Saret, Ltd.; J Warren Whitesel

(57) ABSTRACT

In a connector provided with a locking member (29) for locking a connection state between a connector (12) and a connection object (11), the locking member is assembled in an assembling portion (31) of a housing member (27) of the connector. The locking member has an engaging portion (29-1) at its one end, an operating portion (29-3) at the other end, and a pivot portion formed at a particular position between the engaging portion and the operating portion. The pivot portion has a first pivot (29-5) protruding on the side of one surface and a second pivot (29-6) protruding on the side of the other surface. The assembling portion has a pivot bearing portion (35) rotatably clamping the first and the second pivots. The engaging portion is engaged the connection object. The an operating portion is for receiving operation force. The housing member holds a contact member (25).

13 Claims, 10 Drawing Sheets

CONNECTION APPARATUS HAVING AN IMPROVED LOCKING MECHANISM FOR MAINTAINING A CONNECTION STATE

BACKGROUND OF THE INVENTION

The present invention relates to a connector having a locking mechanism for maintaining a connection state established between the connector and a connection object.

For example, Japanese Unexamined Utility Model Publication (JP-U) No. S62-55883 discloses a locking mechanism for maintaining two connectors in a connection state. The locking mechanism comprises a locking member to be engaged with both of the connectors. When one of the connectors is mounted on a circuit board, the locking member is properly positioned and fixed by a screw so as to prevent the mounted connector from being shaken on the circuit board and unstable.

However, such proper positioning is not easy. In addition, fixation by the screw is required so that the cost is increased. After the fixation, the screw, once fastened, may possibly be loosened and released.

Japanese Unexamined Utility Model Publication (JP-U) No. H04-16886 or H05-68085 discloses a connector comprising a locking member assembled therein. In the connector, the locking member is held by a housing of the connector to be adapted to perform seesaw motion with its intermediate portion as a support point. When the connector is connected to a mating connector, the locking member is engaged with the mating connector to be put into an operation mode.

However, if the connectors are forcibly disconnected from each other while the locking member is in the operation mode, the locking member may be released from a support wall of the housing. In this event, the locking member can not return to its initial position. Thus, the reliability is insufficient. In order to prevent the locking member from being released upon such forcible disconnection, the intermediate portion as the support point must be strengthened. This inevitably increases the size of the locking member to inhibit the miniaturization of the profile of the connector.

SUMMARY OF THE INVENTION

It is therefore an object of the present invention to provide a connector which can easily be positioned with respect to a circuit board and can reliably be fixed to the circuit board.

It is another object of the present invention to provide a small-sized connector which is capable of preventing a locking member from being released from a housing even if a mating connector is forcibly disconnected from the connector.

It is still another object of the present invention to provide a connection apparatus which achieves all of the above-mentioned objects.

Other objects of the present invention will become clear as the description proceeds.

According to a first aspect of the present invention, there is provided a connector which is to be attached to a panel for connection with a connection object and which comprises a contact member, a housing member holding the contact member, and a locking member connected to the housing member for locking a connection state between the connector and the connection object. The locking member comprises a held portion held by the housing member, an engaging portion extending from the held portion to be engaged with the connection object, and a threaded portion integral with the held portion to be used for attachment to the panel.

According to a second aspect of the present invention, there is provided a connector which is for connecting to a connection object and comprises a locking member for locking a connection state between the connector and the connection object, a contact member, and a housing member holding the contact member and having an assembling portion in which the locking member is assembled. The locking member comprises an engaging portion formed at its one end to be engaged with the connection object, an operating portion formed at the other end to receive operation force, and a pivot portion formed at a particular position between the engaging portion and the operating portion. The assembling portion has a pivot bearing portion rotatably clamping the pivot portion. The pivot portion comprises a first pivot protruding on the side of one surface and a second pivot protruding on the side of the other surface. The pivot bearing portion clamps the first and the second pivots.

According to a third aspect of the present invention, there is provided a connection apparatus which comprises a first connector to be attached to a panel for connection with a connection object and a second connector as the connection object. The first connector comprises a first contact member, a first housing member holding the first contact member, and a first locking member connected to the first housing member for locking a connection state between the first and the second connectors. The first locking member comprises a held portion held by the first housing member, a first engaging portion extending from the held portion to be engaged with the connection object, and a threaded portion integral with the held portion to be used for attachment to the panel. The second connector comprises a second contact member to be connected to the first contact member, a second housing member holding the second contact member, and a second locking member for locking a connection state between the first and the second connectors. The second housing member has an assembling portion in which the second locking member is assembled. The second locking member comprises a second engaging portion formed at its one end to be engaged with the first connector, an operating portion formed at the other end to receive operation force, and a pivot portion formed at a particular position between the engaging portion and the operating portion. The assembling portion has a pivot bearing portion rotatably clamping the pivot portion.

DESCRIPTION OF THE PREFERRED EMBODIMENTS

Figure 1:
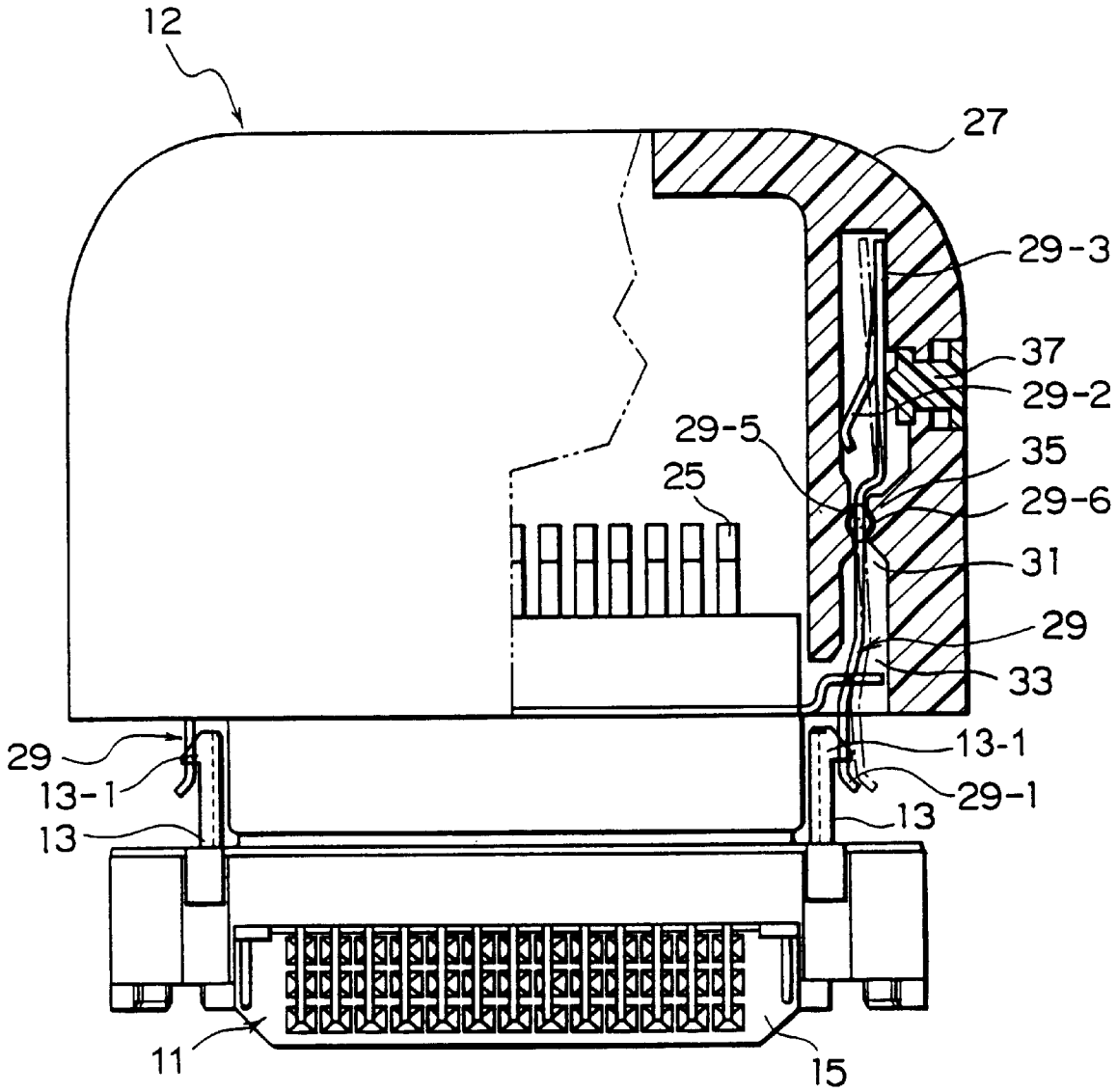
FIG. 1 is a partially sectional plan view of a connection apparatus according to an embodiment of the present invention.
Figure 2:
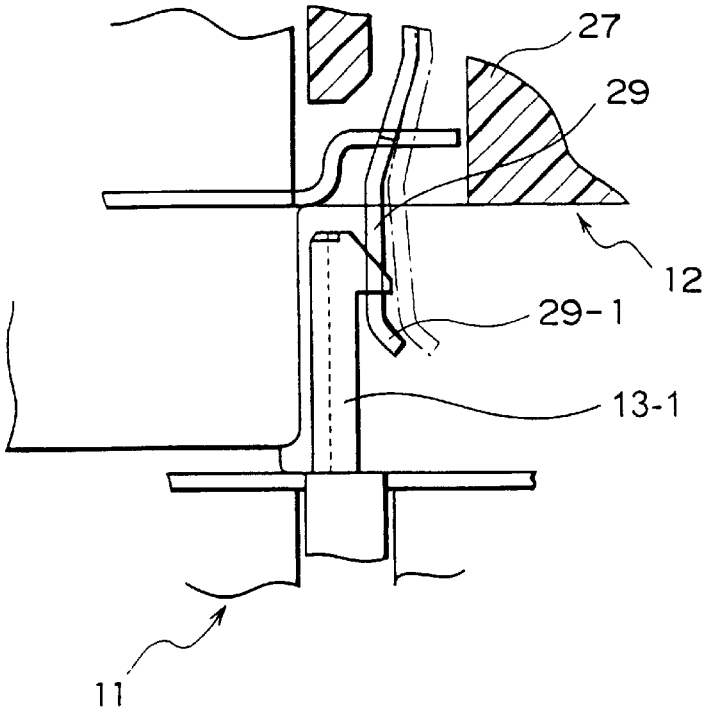
FIG. 2 is an enlarged view of a characteristic part of the connection apparatus illustrated in FIG. 1.

Referring to FIGS. 1 and 2, description will be made about a connection apparatus according to an embodiment of the present invention.

The connection apparatus illustrated in the figure includes a first connector 11 comprising a receptacle connector and a second connector 12 comprising a plug connector as a connection object to be coupled and connected to the first connector 11 in a connector coupling direction.

Figure 3:
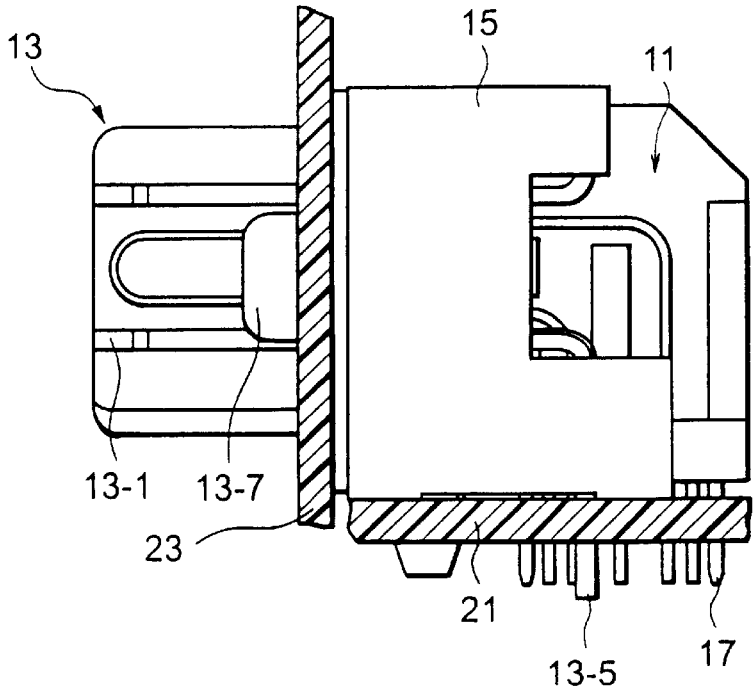
FIG. 3 is a side view of a first connector contained in the connection apparatus illustrated in FIG. 1 when it is attached to a panel and a circuit board.
Figure 4:
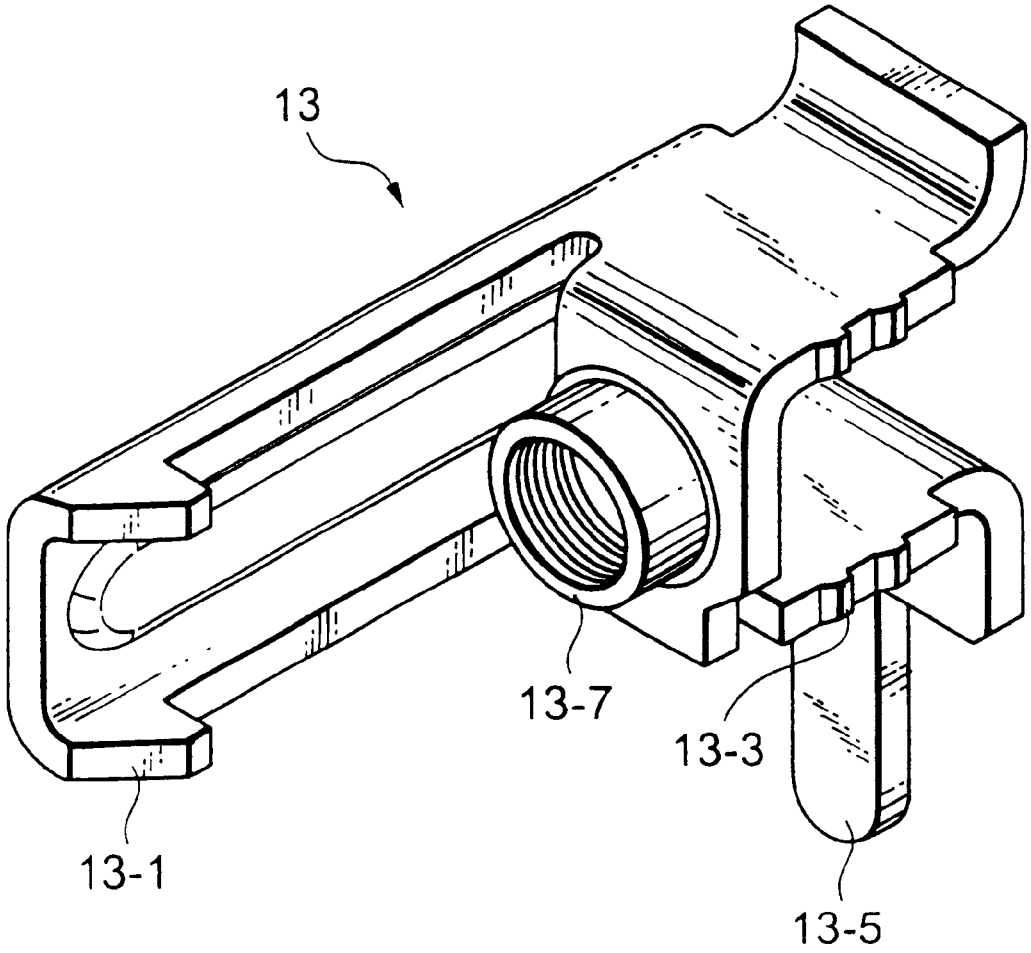
FIG. 4 is a perspective view of a locking member of the first connector illustrated in FIG. 3.
Figure 5:
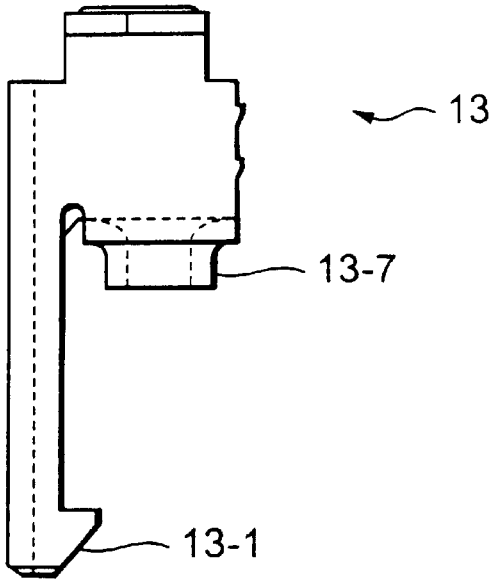
FIG. 5 is a top view of the locking member illustrated in FIG. 4.
Figure 6:
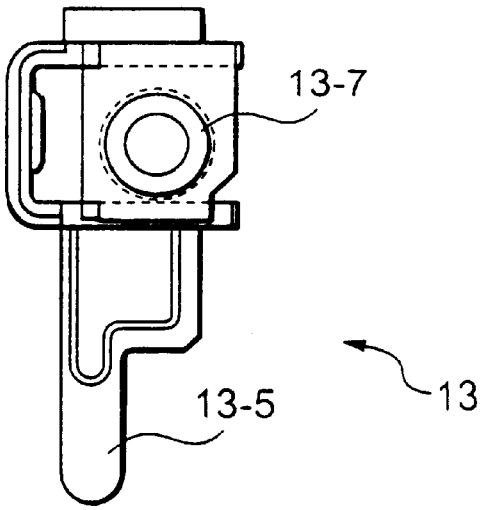
FIG. 6 is a front view of the locking member illustrated in FIG. 4.
Figure 7:
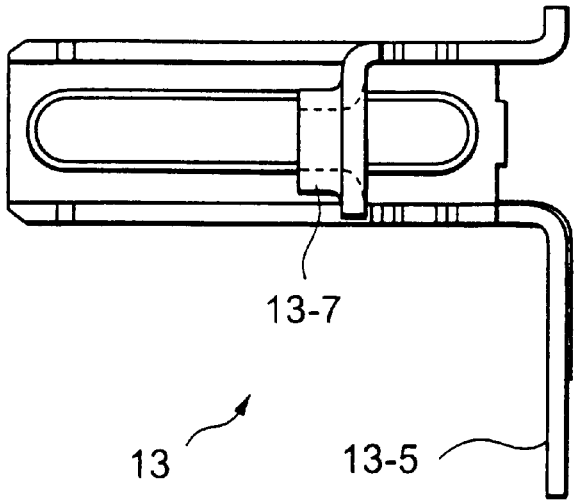
FIG. 7 is a right side view of the locking member illustrated in FIG. 4.
Figure 8:
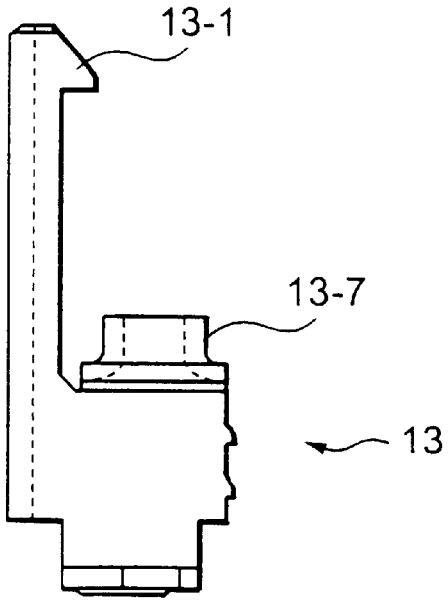
FIG. 8 is a bottom view of the locking member illustrated in FIG. 4.
Figure 9:
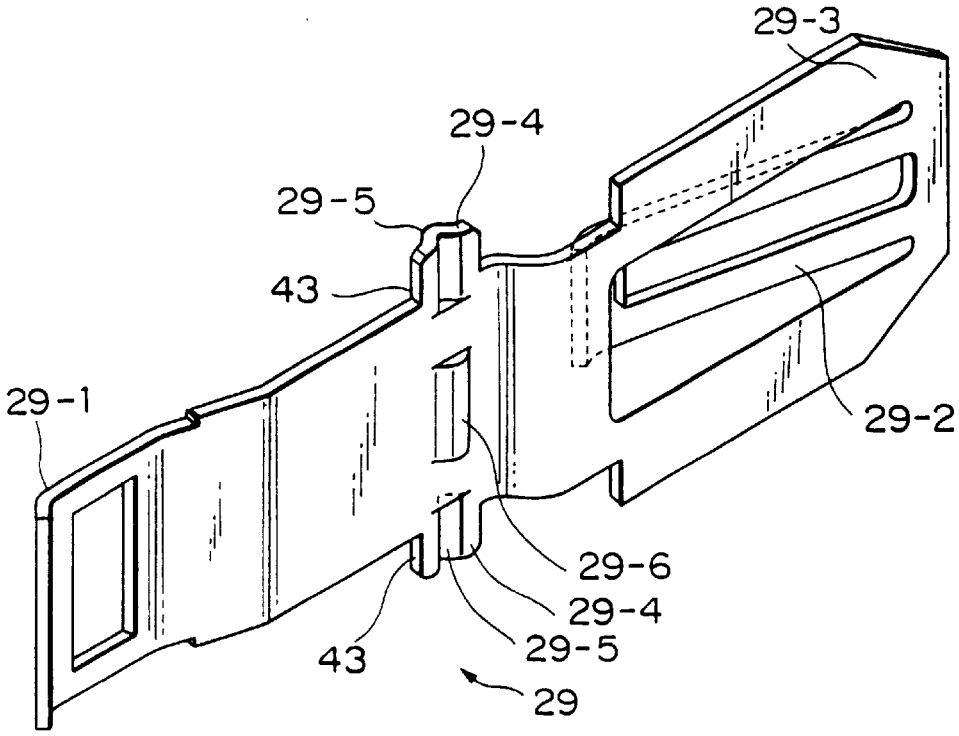
FIG. 9 is a perspective view of a locking member of a second connector contained in the connection apparatus illustrated in FIG. 1.
Figure 10:
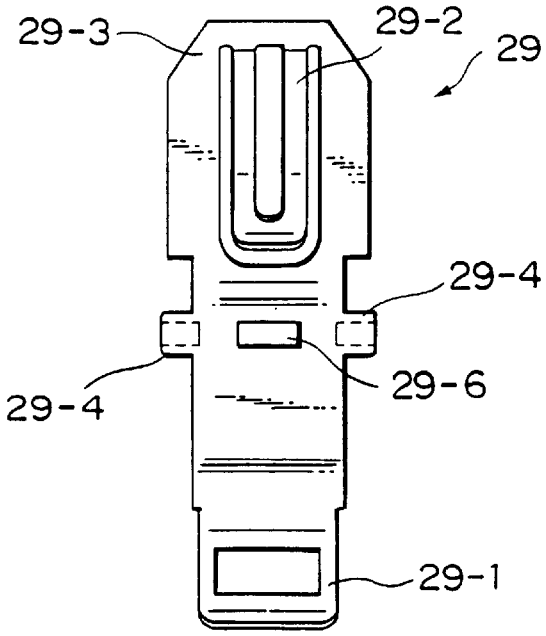
FIG. 10 is a front view of the locking member illustrated in FIG. 9.
Figure 11:
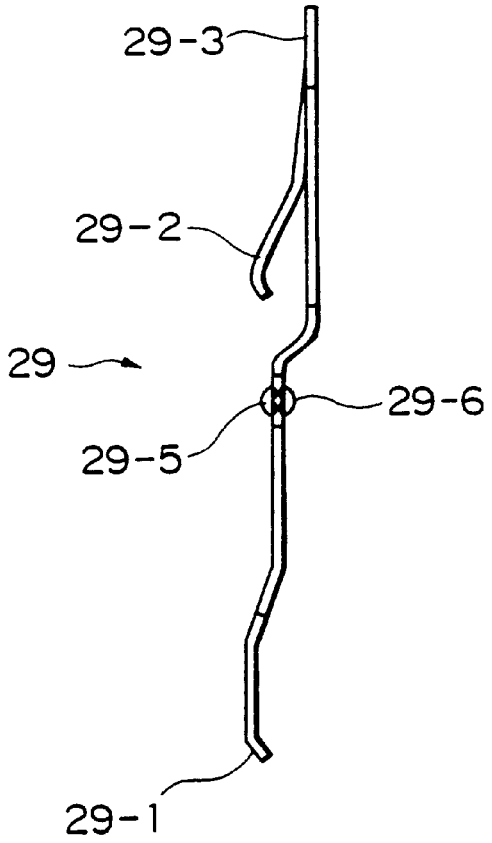
FIG. 11 is a right side view of the locking member illustrated in FIG. 9.
Figure 12:
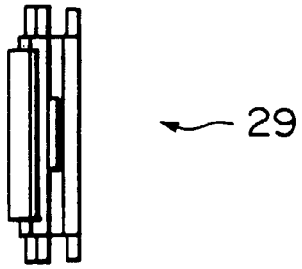
FIG. 12 is a bottom view of the locking member illustrated in FIG. 9.

Referring to FIG. 3 in addition, the first connector 11 comprises a plurality of first contact members 17, a first housing member 15 directly holding the first contact members 17, and a pair of lock lugs 13 as a first locking member connected to the first housing member 15 for locking the first and the second connectors 11 and 12 in a connection state. The first housing member 15 is made of insulator material. Each of the first contact members 17 is made of electroconductive material.

The first housing member 15 is mounted on an upper surface of a horizontal circuit board 21 with through holes formed therein and attached and fixed to a panel 23 vertically extending. The panel 23 is provided with a fitting hole penetrating therethrough. Each of the lock lugs 13 has a through-hole terminal portion 13-5 inserted through a grounding through hole of the circuit board 21 and fixed by soldering.

Referring to FIGS. 4 through 8 in addition, each of the lock lugs 13 has a pair of locking claw portions 13-1 as a first engaging portion to be engaged with the second connector 12, a press-fitting dowel portion 13-3 as a held portion to be fixed and held in an assembling hole of the first housing member 15 by press fitting, a boss 13-7 as a threaded portion inserted through the fitting hole of the panel 23 and provided with a threaded hole, and the through-hole terminal portion 13-5 which is inserted through the grounding through hole of the circuit board 21 to be fixed to the circuit board 21 and which serves as a positioning member. Each of the lock lugs 13 is formed as an integral grounding lug. The boss 13-7 protrudes from the panel 23 in the illustrated example but may not protrude.

Turning back to FIG. 1, the second connector 12 will be described.

The second connector 12 comprises a plurality of contact members 25 to be connected to the first contact members 17 in one-to-one correspondence, a second housing member 27 as a shell or a hood indirectly holding the second contact members 25, and a pair of lock engaging members 29 as a second locking member for locking the connection state between the first and the second connectors 11 and 12. The second housing member 27 is made of insulator material. Each of the second contact members 17 is made of electroconductive material.

The second housing member 27 has a pair of assembling portions 31 (only one of which is illustrated in FIG. 1) where the lock engaging members 29 are assembled, respectively. Each of the lock engaging members 29 extends in the connector coupling direction. Each of the assembling portions 31 is provided with a bottomed assembling hole 33 extending in the connector coupling direction to assemble the lock engaging member 29 therein.

Referring to FIGS. 9 through 12, each of the lock engaging members 29 is made of a plate material and has a longitudinal one end provided with a locked portion 29-1 as a second engaging portion and a longitudinal other end provided with an operating portion 29-3 together with an auxiliary spring 29-2 which is for urging the locked portion 29-1 in one direction with respect to the first and the second pivots 29-5 and 29-6. The locked portion 29-1 serves as a portion to be engaged with the locking claw portions 13-1 of the first connector 1 in the connector coupling direction.

The lock engaging member 29 is provided with a pair of protrusions 29-4 formed at a particular position between the longitudinal one end and the longitudinal other end to protrude from opposite ends in a widthwise direction. The lock engaging member 29 is further provided with a pair of first pivots 29-5 and a second pivot 29-6 protruding at longitudinal positions corresponding to the protrusions 29-4. The first pivots 29-5 protrude on the side of one surface of the lock engaging member 29 while the second pivot 29-6 protrudes on the side of the other surface opposite to the one surface. A combination of the first and the second pivots 29-5 and 29-6 will be referred to as a pivot portion.

As illustrated in FIG. 1, the first and the second pivots 29-5 and 29-6 are rotatably clamped by a pivot bearing portion 35 formed in the second housing member 27 when the lock engaging member 29 is assembled into the assembling portion 31. The lock engaging member 29 pivotally supported by the assembling portion 31 as described above is urged by the auxiliary spring 29-2 in one direction as an urging direction. Specifically, the locked portion 29-1 is urged in a direction of maintaining the engagement with the locking claw portion 13-1 of the first connector 11 with the pivot portion as a support point.

Figure 13:
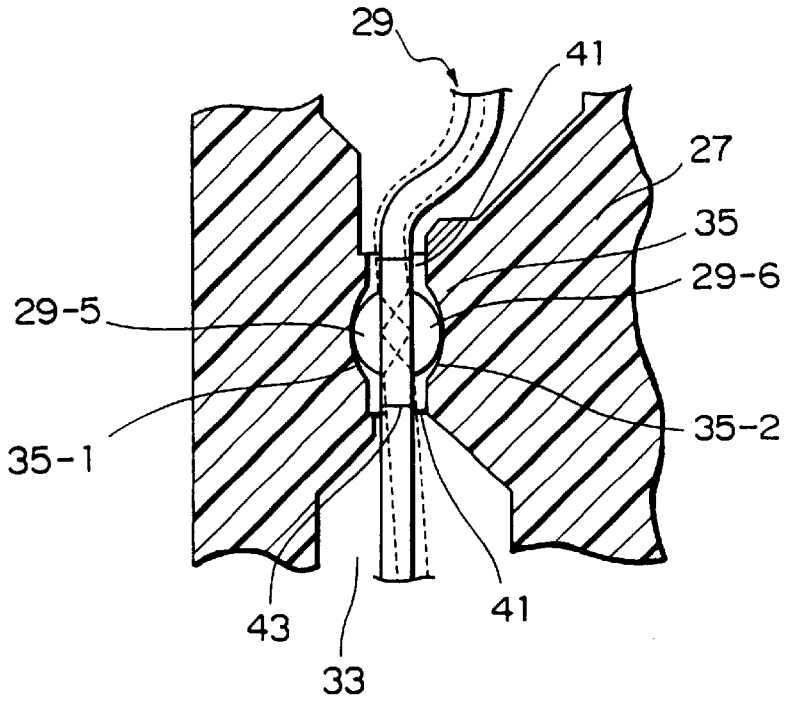
FIG. 13 is an enlarged sectional view of a characteristic part of the second connector in the connection apparatus illustrated in FIG. 1.

Next referring to FIG. 13, the description will be made of one example of a relationship between the lock engaging member 29 and the assembling portion 31.

The pivot bearing portion 35 has first and second pivot holding concave walls 35-1 and 35-2 opposite to each other. The first and the second pivot holding concave walls 35-1 and 35-2 are formed so that an approximate center portion of the bottomed assembling hole 33 is narrowed in the connector coupling direction and that the first and the second pivots 29-5 and 29-6 are clamped therebetween. Thus, a pivot bearing structure having the support point is formed between the first and the second pivot holding concave walls 35-1 and 35-2 and the first and the second pivots 29-5 and 29-6. Each of the first and the second pivots 29-5 and 29-6 has a curved portion. Each of the first and the second pivot holding concave walls 35-1 and 35-2 has a curved surface.

It is assumed here that the first and the second connectors 11 and 12 are coupled and connected to each other and that the locked portions 29-1 is engaged with the locking claw portions 13-1 to establish a locked state.

In order to cancel the locked state, an operation button 37 is pushed to displace an operating portion 29-3 of the lock engaging member 29. Then, the locked portion 29-1 of the lock engaging member 29 is rotated around a pivot point 39 in a direction opposite to the urging direction of the auxiliary spring 29-2. As a consequence, the engagement between the locked portion 29-1 and the locking claw portion 13-1 is released. At this time, the second pivot 29-6 is guided to the inside of the second pivot holding concave wall 35-2 so that the center of rotation can be continuously kept at the same position.

This also applies when the locked state is recovered. Specifically, when the lock engaging member 29 is reversely rotated by reaction force of the auxiliary spring 29-2, the center of rotation is kept at the same position. As a result, the lock engaging member is reliably returned to its initial position.

The second housing member 27 has holding walls 41 each of which is formed as a stepped portion adjacent to the first and the second pivot holding concave walls 35-1 and 35-2. Each of the protrusions 29-4 is provided with a contacting portion 43 to be brought into contact with the holding walls 41. Since the holding walls 41 and the contacting portion 43 are brought into contact with each other, the lock engaging member 29 is prevented from excessive displacement in the coupling and the releasing directions. As a result, the second connector 12 is prevented from being released even if the locked portion or a locking mechanism is subjected to excessive force in the releasing direction upon the first and the second connectors 11 and 12 are disconnected from each other.

Furthermore, when the lock engaging member 29 is assembled into the bottomed assembling hole 33, a click feeling is given to an operator when the contact is established between the holding walls 41 and the contacting portion 43. Thus, the reliability and the efficiency in assembling can be improved without assembling errors.

Figure 14:
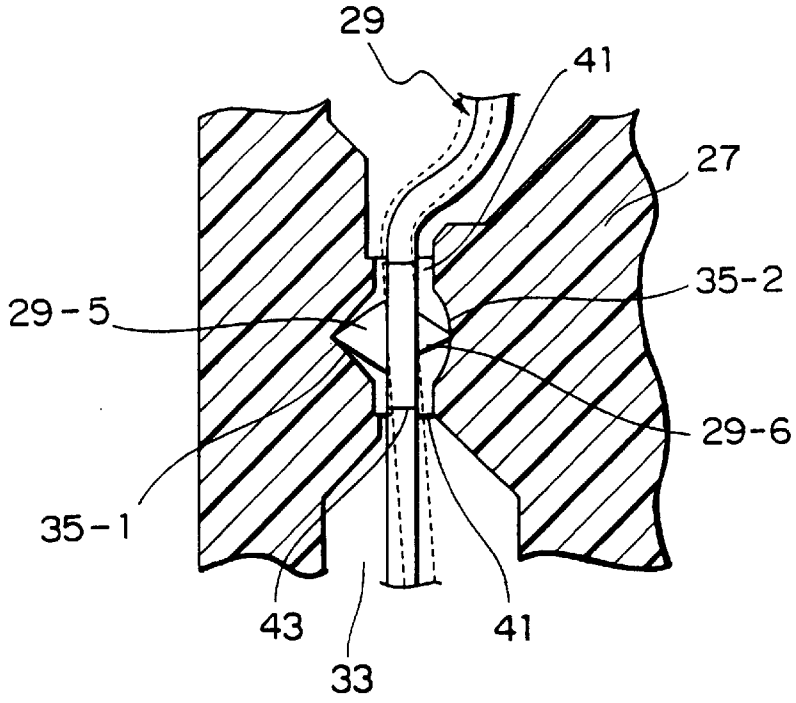
FIG. 14 is an enlarged sectional view of a characteristic part of a modification of the second connector.

Referring to FIG. 14, the description will be made of another example of the relationship between the lock engaging member 29 and the assembling portion 31. Similar parts are designated by like reference numerals and will not be described any longer.

Each of the first and the second pivots 29-5 and 29-6 of the lock engaging member 29 has an angled portion. In correspondence, the first pivot holding concave wall 35-1 has a V-grooved surface for receiving the angled portion of each of the first pivots 29-5. On the other hand, the second pivot holding concave wall 35-2 has a curved surface for receiving the second pivot 29-6.

In order to cancel the engagement of the lock engaging member 29, the locked portion 29-1 is displaced with the first pivot 29-5 as the support point. In this event, the second pivot 29-6 moves along the second pivot holding concave wall 35-1 but does not interfere the displacement of the locked portion 29-1.

Thereafter, when the lock engaging member 29 is returned to its initial position by the reaction force of the auxiliary spring 29-2, the second pivot 29-6 moves along the second pivot holding concave wall 35-1. However, since the first pivots 29-5 are kept unchanged in position so that the lock engaging member 29 can be returned back into the former position before the locked state is cancelled.

Figure 15:
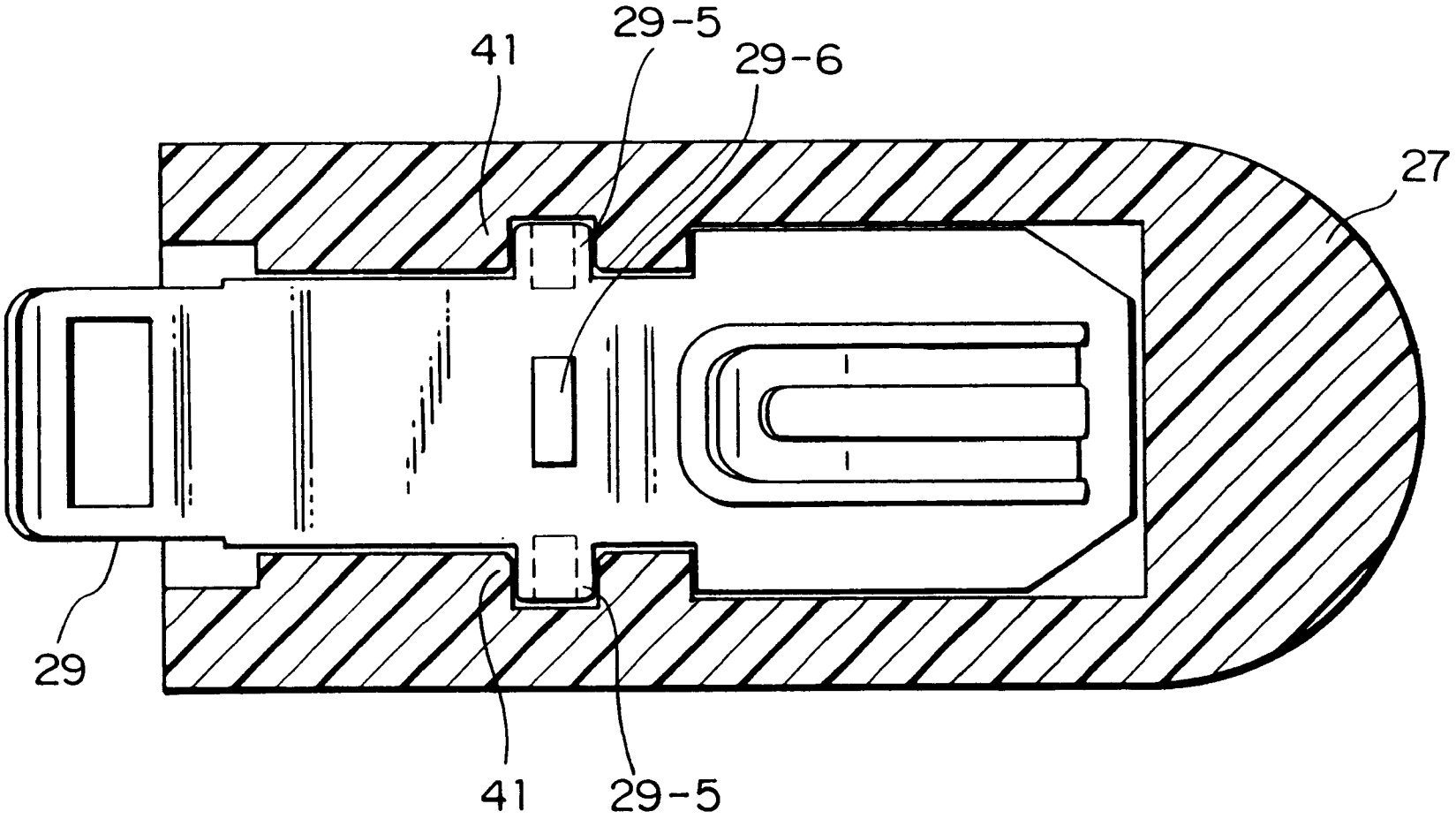
FIG. 15 is a sectional view of another modification of the second connector.
Figure 16:
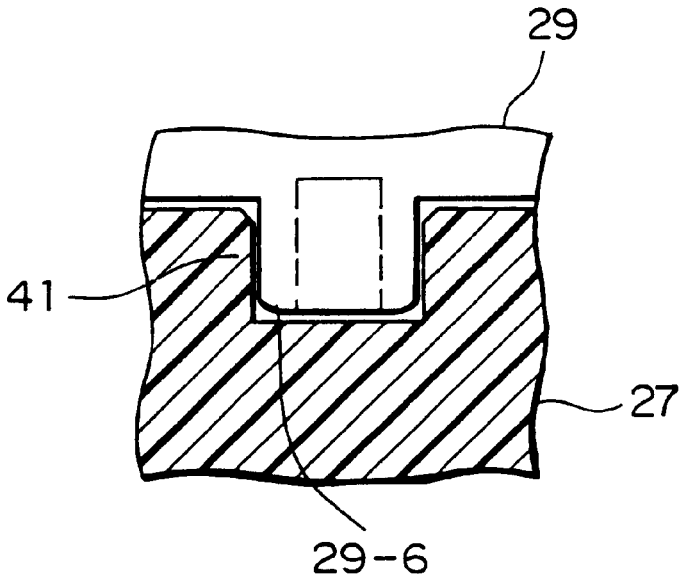
FIG. 16 is an enlarged sectional view of a characteristic part of the second connector illustrated in FIG. 15.
Figure 17:
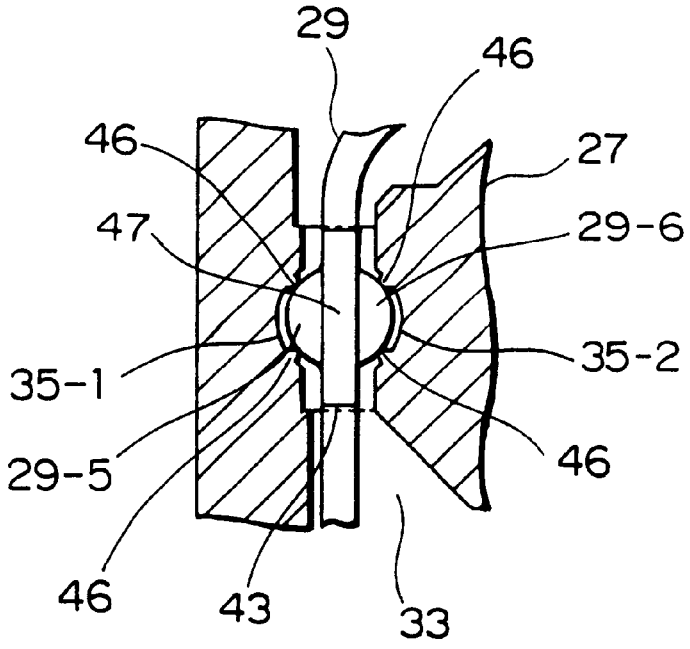
FIG. 17 is a sectional view similar to FIG. 13 but for the second connector illustrated in FIG. 15.

Referring to FIGS. 15 through 17, the description will be made of a modification of the second connector 15.

In the modification, each of the first and the second pivot holding concave walls 35-1 and 35-2 is provided with a pair of supporting portions 46 protruded therefrom. The first and the second pivots 29-5 and 29-6 are slidably supported on the supporting portions 46. As a result, the lock engaging member 29 is supported by the second housing member 27 at a multi-point (four points in the figure). The locked portion 29-1 and the operating portion 29-3 at one end and the other end of the lock engaging member 29 are rotatable around a center point 47 of the first and the second pivots 29-5 and 29-6.

As illustrated in FIGS. 16 and 17, the holding elements 45 are fitted in the first and the second pivot holding concave walls 35-1 and 35-2 so that the load is applied to a plane in each of the holding walls 41 which extends along the pivot axis. Therefore, it will readily be understood that the reliable fixation is achieved.

What is claimed is:

1. A connector for making a connection to a connection object, said connector comprising:

a locking member for locking a connection state between said connector and said connection object;

a contact member; and a housing member holding said contact member and having an assembling portion in which said locking member is assembled, said locking member comprising:

an engaging portion formed at its one end to be engaged with said connection object;

an operating portion formed at its one end to be engaged with said connection object;

an operating portion formed at the other end to receive an operation force; and a pivot portion formed at a particular position between said engaging portion and said operating portion, said assembling portion having a pivot bearing portion rotatably clamping said pivot portion, said pivot portion comprising a first pivot protruding on the side of one surface and a second pivot protruding on the side of the other surface, said pivot bearing portion clamping said first and said second pivots, said second pivot having a contacting portion, said assembling portion having a stepped portion to be brought into contact with said contacting portion to prevent said locking member from being released.

2. A connector as claimed in claim 1, wherein said locking member has an auxiliary spring for urging said engaging portion in one direction with said pivot portion forming a support point.

3. A connector as claimed in claim 1, wherein each of said first and said second pivots has a curved portion, said pivot bearing portion having a curved surface for receiving said curved portions of said first and second pivots.

4. A connector as claimed in claim 1, wherein each of said first and said second pivots has an angled portion, said pivot bearing portion having a V-grooved surface for receiving said angled portion of said first pivot and a curved surface for receiving said second pivot.

5. A connection apparatus comprising the connector according to claim 1 and a counterpart connector to be attached to a panel for making a connection with the connector of claim 1, said counterpart connector comprising:

a counterpart contact member;

a counterpart housing member holding said counterpart contact member; and a counterpart locking member connected to said counterpart housing member for locking a connection state between said counterpart connector and the connector of according to claim 1, said counterpart locking member comprising:

a hold portion held by said counterpart housing member;

a counterpart engaging portion extending from said hold portion to engage the engaging portion of the connector of claim 1; and a threaded portion integral with said hold portion for attachment to said panel.

6. A connector as claimed in claim 5, wherein said counterpart locking member further comprises a terminal portion extending from said hold portion to be fixed to a circuit board on which said counterpart connector is mounted.

7. A connector as claimed in claim 6, wherein said circuit board has a through hole, said terminal portion being inserted into said through hole and fixed to said circuit board.

8. A connector for making a connection to a connection object, comprising:

a locking member for locking a connection state between said connector and said connection object;

a contact member; and a housing member holding said contact member and having an assembling portion in which said locking member is assembled, said locking member comprising:

an engaging portion formed at its one end to be engaged with said connection object;

an operating portion formed at the other end to receive an operation force; and a pivot portion formed at a particular position between said engaging portion and said operating portion, said assembling portion having a pivot bearing portion rotatably clamping said pivot portion, said pivot portion comprising a first pivot protruding on the side of one surface and a second pivot protruding on the side of the other surface, said pivot bearing portion clamping said first and said second pivots, each of said first and said second pivots having an angled portion, said pivot bearing portion having a V-grooved surface for receiving said angled portion of said first pivot and a curved surface for receiving said second pivot.

9. A connector as claimed in claim 8, wherein said locking member has an auxiliary spring for urging said engaging portion in one direction with said pivot portion as a support point.

10. A connector as claimed in claim 8, wherein each of said first and said second pivots has a curved portion, said pivot bearing portion having a curved surface for receiving said curved portion.

11. A connection apparatus comprising the connector according to claim 8 and a counterpart connector to be attached to a panel for making a connection with the connector of claim 8, said counterpart connector comprising:

a counterpart contact member;

a counterpart housing member holding said counterpart contact member; and a counterpart locking member connected to said counterpart housing member for locking a connection state between said counterpart connector and the connector of claim 8, said counterpart locking member comprising:

a hold portion held by said counterpart housing member;

a counterpart engaging portion extending from said hold portion to engage the engaging portion of the connector according to claim 8; and a threaded portion integral with said hold portion to be used for attachment to said panel.

12. A connector as claimed in claim 11, wherein said counterpart locking member further comprises a terminal portion extending from said hold portion to be fixed to a circuit board on which said counterpart connector is mounted.

13. A connector as claimed in claim 12, wherein said circuit board has a through hole, said terminal portion being inserted into said through hole and fixed to said circuit board.

* * * * *